United States Patent [19]

Horowitz

[11] 4,084,475

[45] Apr. 18, 1978

[54] GUITAR CONSTRUCTION

[76] Inventor: William M. Horowitz, 2849 W. Jerome St., Chicago, Ill., 60645

[21] Appl. No.: 723,750

[22] Filed: Sep. 16, 1976

[51] Int. Cl.[2] ..... G10D 3/00

[52] U.S. Cl. ..... 84/291; 84/293

[58] Field of Search ..... 84/291, 267, 293, 268

[56] References Cited

U.S. PATENT DOCUMENTS

| | | | |
|---|---|---|---|
| 538,205 | 4/1895 | Back | 84/293 |
| 647,173 | 4/1900 | Almcrantz | 84/293 |
| 2,469,582 | 5/1949 | Strong | 84/293 |
| 2,478,136 | 8/1949 | Stromberg | 84/293 |
| 3,204,510 | 9/1965 | Hopf | 84/291 |
| 3,443,465 | 5/1969 | Kasha | 84/291 |
| 3,869,954 | 3/1975 | Ito | 84/291 |

FOREIGN PATENT DOCUMENTS

| | | | |
|---|---|---|---|
| 829,284 | 3/1938 | France | 84/267 |

*Primary Examiner*—Stephen J. Tomsky

*Attorney, Agent, or Firm*—Silverman, Cass & Singer, Ltd.

[57] ABSTRACT

A guitar is constructed in which the foot end of the fingerboard, which conventionally is secured to the surface of the soundboard for strength, is spaced from such surface thereby permitting the adjacent portion of the soundboard freely to vibrate during play, resulting in greater volume and tone. The underface of the soundboard is braced by means of a fanned arrangement of struts to provide additional stiffness to the soundboard adjacent the neck without substantially damping the vibration thereof.

3 Claims, 7 Drawing Figures

GUITAR CONSTRUCTION

FIELD OF THE INVENTION

The field of the invention is that of stringed instruments in which the soundboard is required to support the tension of the strings, as opposed to the type of instrument in which the soundboard need not be subjected to such tension. The former type of instruments include guitars and ukeleles, while the latter include violins and the violin family of instruments.

The guitar has the anchor which is known as the bridge for the tail or foot end of the strings glued to the surface of the soundboard between the sound hole and the foot end of the guitar. The soundboard is thus required to carry substantially more of the load applied by the strings than any other part of the soundbox. To give additional stiffness and strength, it has been deemed essential to glue the fingerboard to the upper surface of the soundboard between the soundhole and the neck.

The resulting construction is believed to have deprived the guitar, as heretofore made, of a tone and volume that can be added by permitting the entire soundboard to vibrate.

SUMMARY OF THE INVENTION

According to the invention, that portion of the fingerboard which normally overlies the soundboard is spaced therefrom, leaving the soundboard free to vibrate completely around the soundhole. The soundboard is additionally braced by a fanned arrangement of thin struts beneath the head end of the soundboard to resist the stresses set up therein through string tension.

Two different forms of the invention provide for the cantilever arrangement in which the fingerboard is free of the soundboard to enhance the tone and volume of the guitar.

DESCRIPTION OF THE PREFERRED EMBODIMENTS

Figure 1:
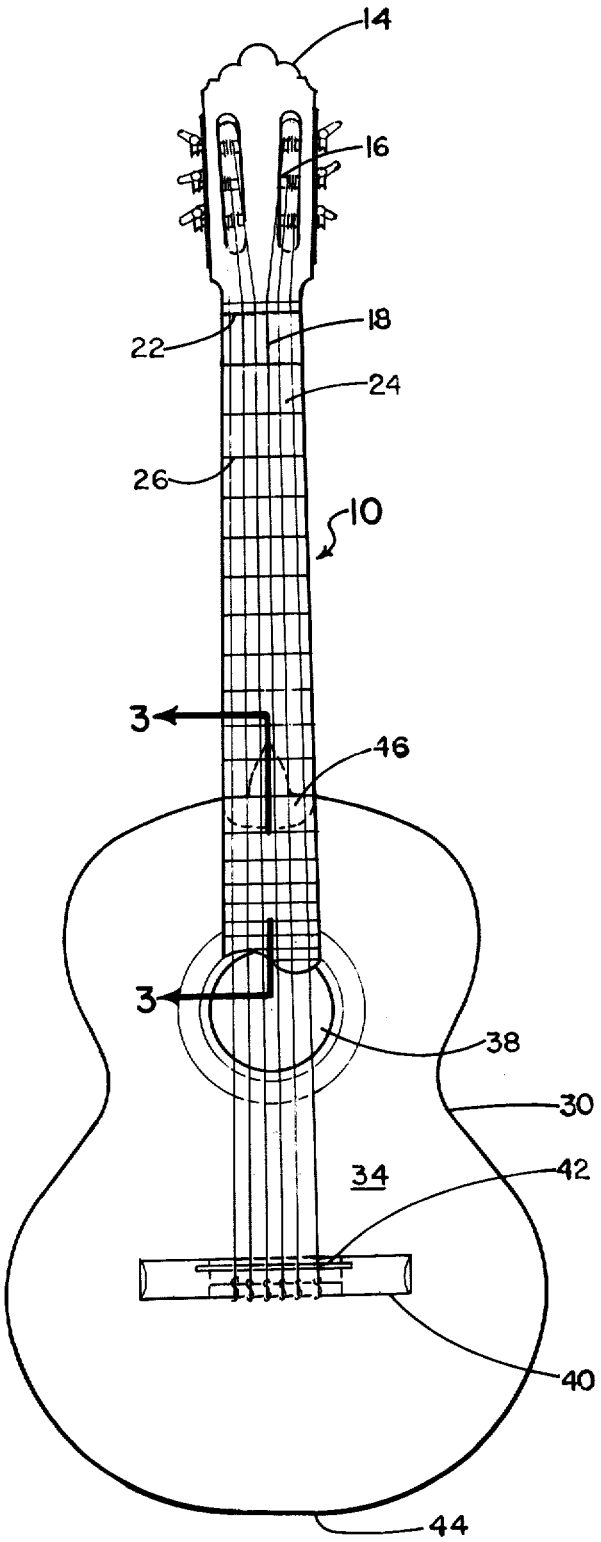
FIG. 1 is a top plan view of a guitar constructed in accordance with the invention.
Figure 2:
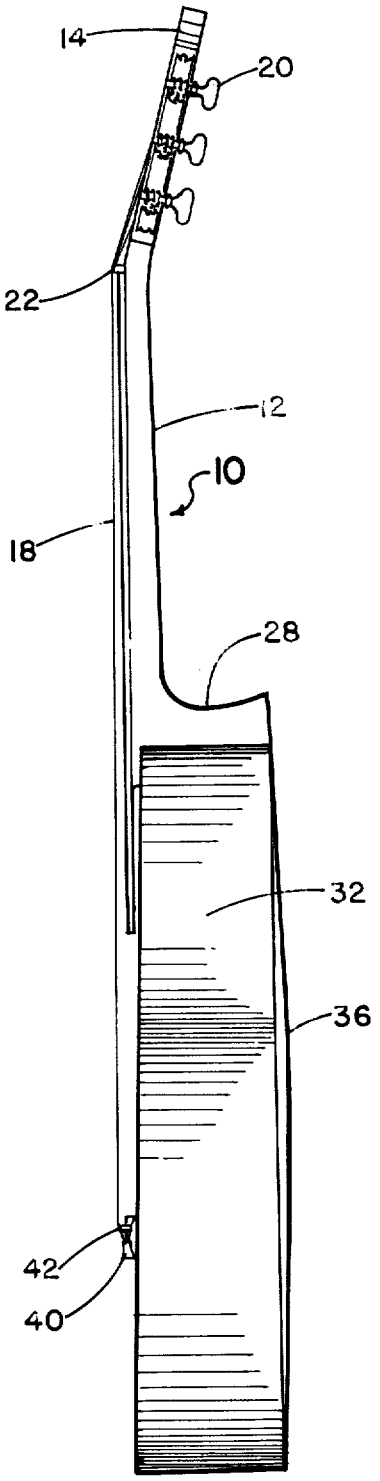
FIG. 2 is a side elevational view of the same.

Referring now to the drawings, the reference character 10 designates generally a guitar which may be considered of the classical type, substantially wholly constructed of wood and depending for its sound and tone output only upon the article itself. Obviously the construction according to the invention may be used with guitars that are modified to amplify the produced sound electrically, but the benefits of the invention are especially achieved in classical type guitars and those popularly referred to as "folk guitars".

Figure 7:
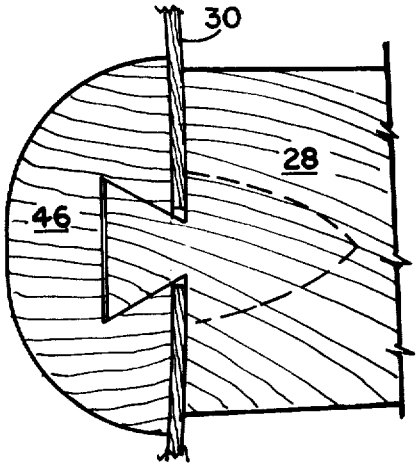
FIG. 7 is a fragmentary sectional view taken generally along the line 7—7 of FIG. 3 and in the direction indicated.

The guitar 10 comprises a wooden neck 12 having a laterally angled head 14 that carries the pegs 16 to which the guitar strings 18 are secured. Two pegs are rotatable by means of suitable keys 20 that apply tension to the strings 18. The strings 18 pass over a guide 22 known as the nut and overlie a fingerboard 24 that is divided into frets by suitable metal spacing bars 26 firmly and accurately secured to the fingerboard. The neck 12 has an enlarged foot 28 that couples the neck to the head end of the soundbox 30, being joined at the surface of the curved side wall 32 of the soundbox. It is conventionally mortised to an internal block as shown in FIG. 7 or may be integral with said internal block.

The soundbox 30 of the guitar 10 is conventional in construction for the most part, and comprises the upper soundboard 34 and the back 36 with the curved side wall 32 spacing the two apart. There is a sound hole 38 and an anchor 40 which is termed the bridge to which the foot ends of the strings are secured. The strings 18 are secured to the tie block of the bridge 40 and are maintained in a tensioned condition between the nut 22 and the saddle 42 that is mounted on the bridge. It will be noted that the bridge 40 is glued to the surface of the soundboard between the sound hole 38 and the foot end 44 of the soundbox 30, so that primarily the soundboard 34 must resist the stress applied by the tensioned strings.

On the interior of the soundbox at the head end thereof, there is a somewhat semicylindrical block 46 which is glued between the soundboard 34 and the back 36 and which sandwiches the head end wall between itself and the foot 28 of the neck 12. In this construction the block 46 and foot 28 are locked together by a mortise and tenon joint.

Figure 5:
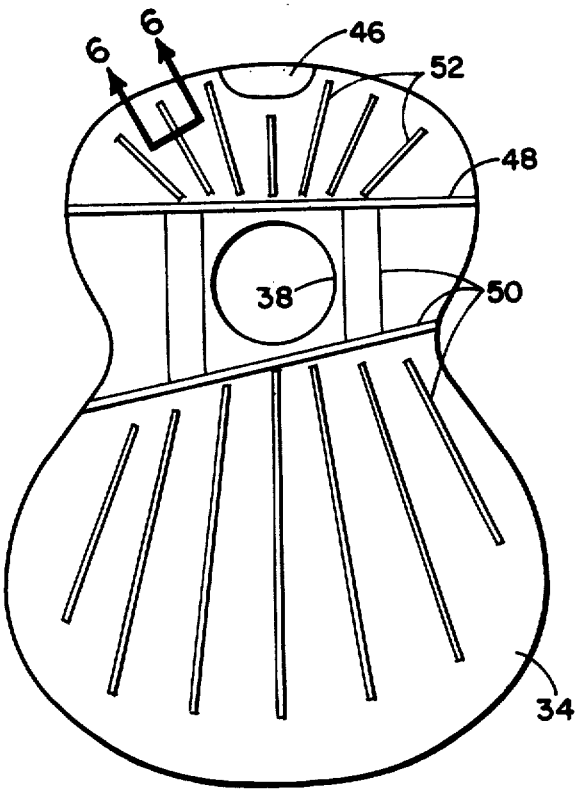
FIG. 5 is a bottom plan view of the soundboard according to the invention illustrating the bracing thereof.
Figure 6:
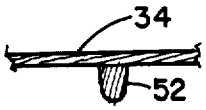
FIG. 6 is a fragmentary sectional view taken generally along the line 6—6 of FIG. 5 and in the direction indicated.

As thus far described in this application, the guitar 10 is conventional, the improvements afforded by the invention being set forth for the most part hereinafter. The interior surface of the soundboard 34 is braced by a variety of struts, which are generally illustrated in FIG. 5. The horizontally arranged strut 48 and all of those below it in the view are substantially conventional. These latter are designated 50. The fanned arrangement of struts designated 52 comprise a part of the invention, as will be explained.

The fingerboard 24, as seen in FIG. 1, extends from the foot 28, that is, the juncture of the neck 12 with the soundbox 30, to the sound hole 38. Accordingly, it passes over the head portion of the soundboard 34. In conventional guitars, the fingerboard is firmly glued to the upper surface of the soundboard over its entire overlying portion, and there is a relatively wide brace or strut (not shown) disposed on the lower surface of the soundboard 34 arranged substantially parallel to the strut 48 and spaced between it and the block 46.

Figure 3:
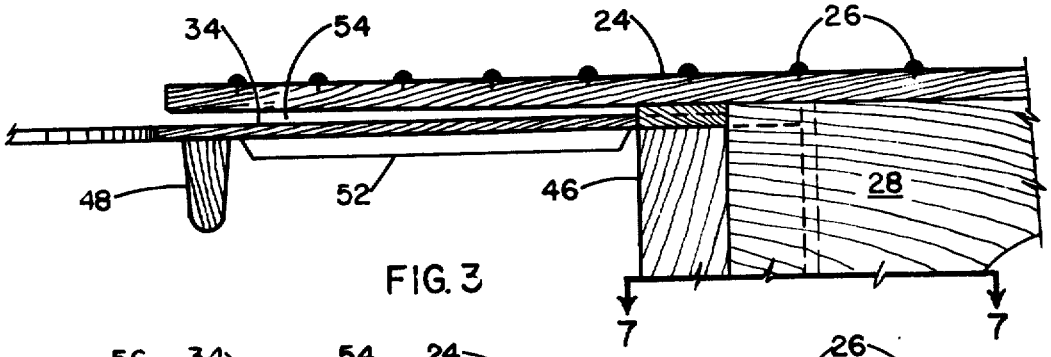
FIG. 3 is a fragmentary sectional view, with portions shown in elevation, taken generally along the line 3—3 of FIG. 1 and in the indicated direction.
Figure 4:
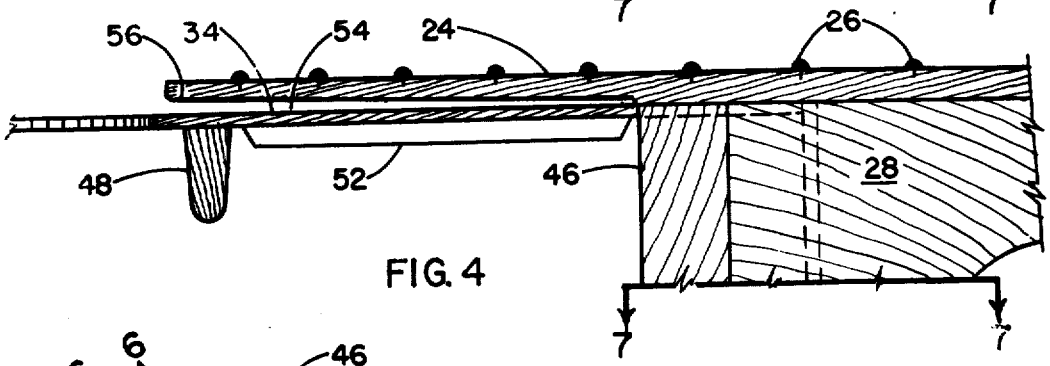
FIG. 4 is a view similar to that of FIG. 3 but illustrating a modified form of the invention.

According to the invention, the fingerboard 24 and the soundboard 34 are spaced apart between the block 46 and the sound hole 38. This provides the space 54 as shown in the drawings. The fingerboard 24 is thus separated from the soundboard leaving the soundboard 34 free to vibrate without damping or restriction. In FIG. 3, this construction is achieved by extending the block 46 by the distance 54 with the neck 12 suitable shaped and dimensioned to enable the fingerboard 24 to assume the cantilever arrangement shown. In FIG. 4, the guitar fingerboard 24 and block are of conventional connection, except that the fingerboard is thinned as at 56 to give rise to the space 54.

The braces or struts 52 are relatively thin but are specifically fanned as shown, generally radiating from the sound hole 38, thereby resisting the strains believed to be produced in the head end of the soundboard 34 by the tensioned strings. These thin struts, while providing the compression strength needed to compensate for the loss of bracing occasioned by the conventional gluing of the fingerboard end to the soundboard, provide a minimum of damping effect upon the soundboard.

Modifications are capable of being made without departing from the spirit or scope of the invention as defined in the appended claims.

What it is desired to secure by Letters Patent of the United States is:

1. A stringed instrument of the guitar variety having

A. a soundbox of wood with a head end and a foot end and formed of soundboard, back and sidewalls, B. a neck, C. a head, D. a sound hole provided in the soundboard, E. a transverse bridge firmly secured to the surface of the soundboard between the sound hole and the foot end of the soundbox, F. a plurality of strings stretched from the head to the soundbox, the soundbox ends of the strings being anchored only to the bridge, G. a fingerboard extending from the head along the neck and over the soundboard to the sound hole, H. the neck being secured to the soundbox at the head end opposite the foot end, I. that portion of the fingerboard between the head end of the soundbox and the sound hole being spaced from the soundboard to provide a substantial cantilevered length overlying the soundboard, J. means bracing the soundboard and secured to its undersurface comprising a series of relatively thin struts extending from the general location of the hole and fanning outwardly away from the soundhole toward the foot end of the soundbox, and other struts generally framing the sound hole and K. means bracing the portion of the soundboard beneath the overlying cantilevered length secured to the undersurface of the soundboard and comprising a series of thin struts extending from the vicinity of the sound hole and fanned about the hole substantially to encompass the majority of the central area of the soundboard between the sound hole and the head end of the soundbox.

2. The stringed instrument as claimed in claim 1 in which there is an internal block at the head end of the soundbox extending from the back and slightly above the soundboard, the fingerboard being substantially uniform in thickness along its complete length and being secured to the said block while the said cantilevered length extends forwardly from the block and the spacing from the soundboard is defined by the amount of the block which extends above the soundboard.

3. The stringed instrument as claimed in claim 1 in which the cantilevered length of the fingerboard is thinner than the remainder of the fingerboard, the thinner portion being on the bottom of the fingerboard such that the unthinned portion is secured to the neck and a small portion of the soundbox at said head end while the thinned portion is unsupported over the soundboard.

* * * * *